US005348057A

United States Patent [19]

Corain et al.

[11] Patent Number: 5,348,057

[45] Date of Patent: Sep. 20, 1994

[54] TAKER GRIPPER IN WHICH THE WEDGE MOVES AXIALLY WITHIN THE HOOK

[75] Inventors: Luciano Corain, Vicenza; Giulio Bortoli, Schio, both of Italy

[73] Assignee: Nuovopignone Industrie Meccahniche E Fonderia S.p.A., Florence, Italy

[21] Appl. No.: 75,027

[22] Filed: Jun. 11, 1993

[30] Foreign Application Priority Data

Jun. 23, 1992 [IT] Italy ..... MI92A001534

[51] Int. Cl.[5] ..... D03D 47/20

[52] U.S. Cl. ..... 139/448

[58] Field of Search ..... 139/446, 448, 447, 438

[56] References Cited

U.S. PATENT DOCUMENTS

| | | | |
|---|---|---|---|
| 3,915,201 | 10/1975 | Mackie | 139/448 |
| 4,226,265 | 10/1980 | Zollinger | 139/448 |
| 4,371,008 | 2/1983 | Freisler | 139/448 |
| 4,520,851 | 6/1985 | Rohr et al. | 139/448 |
| 5,113,914 | 5/1992 | Corain | 139/448 |

FOREIGN PATENT DOCUMENTS

| | | |
|---|---|---|
| 0235078 | 1/1987 | European Pat. Off. . |
| 0285591 | 3/1988 | European Pat. Off. . |
| 2907540 | 2/1979 | Fed. Rep. of Germany . |
| 2083844 | 8/1981 | United Kingdom . |

*Primary Examiner*—Andrew M. Falik

*Attorney, Agent, or Firm*—Morgan & Finnegan

[57] ABSTRACT

A taker gripper for loom use, of the type in which a wedge moves axially within a hook. The weft to be drawn, and which is wedged into the narrow V recess formed on one side between the wedge and the hook, is also maintained elastically pressed against the shallow recess that is provided in the outer lower surface of the hook by an elastic blade. The elastic blade, moreover, is fixed by its rear end to the wedge or to the gripper body. The inner surface of the hook on the side opposite the side that comprises the narrow V recess is formed so that it diverges from the corresponding surface of the wedge and from the direction of wedge axial movement.

3 Claims, 2 Drawing Sheets

TAKER GRIPPER IN WHICH THE WEDGE MOVES AXIALLY WITHIN THE HOOK

BACKGROUND OF THE INVENTION

1. Field of the Invention

This invention relates to improvements in a taker gripper for loom use, which result in more effective weft clamping and hence a considerable reduction in the danger of the weft escaping from the gripper during its transport, even at the high operating speeds required of modern looms, together with easier release of said weft at the end of its travel.

More specifically, the invention relates to improvements in the taker gripper of our preceding British Patent Application GB-A-2 083 844 published Mar. 31, 1982.

2. Description of the Prior Art

In said patent the gripping and clamping members of the taker gripper consist of a wedge axially movable within a hook positioned horizontally at one end of the gripper body, the wedge being maintained elastically pressed within said hook by a spring acting on that end of a lever extending externally to the gripper body, the lever being hinged at its center to said gripper body and having the end of said wedge hinged to its other end, said hook and said wedge being shaped to form between them, on one side, a narrow V recess. In this manner on penetrating into said narrow V recess, the weft is progressively inserted therein until it becomes wedged to hence remain trapped, it being released in known manner by an axial movement of separation of the wedge from the hook, this being achieved automatically by making a fixed cam act on said projecting end of said lever.

Although this known construction involving axial movement between the wedge and hook has the merit of a very small vertical space requirement for the gripper so that the giver grippers used can be very small, resulting in very limited contact between the grippers and the warp yarns, with consequent limited wear of these latter, and the further merit of reliably wedging the weft in its V recess, it is totally unable to protect against weft withdrawal from the top of the taker gripper during the travel of this latter. In this respect, in order to increase the clamping of the weft by the taker gripper and hence reduce the possibility of weft escape during the gripper travel, said wedge of the known taker gripper is provided with a flat spring or helix-twisted flat spring in that part forming said V recess with said hook. However even though this latter construction provides more effective protection against weft withdrawal, it has drawbacks due substantially to the fact that at each axial movement of the wedge, said spring hits against the hook inner wall forming said V recess, leading to wear of the spring and the inevitable formation thereon of small burrs which can compromise the integrity of the weft and damage it irreparably. Again, the small axial movement of separation of the wedge from the hook which occurs automatically each time the taker gripper reaches its end of travel position combined with the fact that the V recess formed by them is necessarily very narrow means that a very small free space is created, this certainly not facilitating the release of the weft from the gripper when in its end of travel position.

SUMMARY OF THE INVENTION

The object of the present invention is to obviate the aforesaid drawbacks by providing a taker gripper of the type in which the wedge moves axially within the hook, which ensures that the weft does not withdraw from its gripping and clamping members during transport, even at high operating speed, which does not damage the weft in any way, and which allows simple release of said weft when the gripper reaches its end of travel position.

This object is substantially attained in that the weft which becomes wedged in the narrow V recess defined between said axially movable wedge and said hook is retained by a gripping and clamping member consisting of an elastic blade pressing against a shallow recess provided in the outer lower surface of the hook.

In this manner, in addition to being gripped by the elastic blade the weft is also compelled to undergo sudden changes of direction of almost a right angle both at its insertion into and its exit from said shallow recess in the hook, so providing it with excellent protection against its withdrawal from the top of the gripper.

In addition, the inner surface of the hook on the side opposite that comprising said narrow V recess is formed so that it diverges from the corresponding surface of the wedge and from its direction of axial movement.

In this manner, when the wedge withdraws axially from the hook, effected automatically each time the taker gripper reaches its end of travel position, an empty space is created between said wedge and hook surfaces which, by allowing the wedge to move laterally into it, results in enlargement of the opening on the opposite side comprising said V recess, with corresponding easier weft release.

Hence, the taker gripper for loom use, comprising a gripper body provided at one end with a horizontally positioned hook within which an axially movable wedge is maintained elastically pressed by a spring to form with said hook, on one side thereof, a narrow V recess into which the weft to be drawn is inserted and wedged, said spring acting on that end of a lever extending externally to the gripper body, the lever being hinged at its center to said gripper body and having the free end of said wedge hinged to its other end, is characterized according to the present invention in that said weft is also maintained elastically pressed by an elastic blade against a shallow recess provided in the outer lower surface of the hook, and that inner surface of the hook on the side opposite the side comprising said narrow V recess is formed so that it diverges from the corresponding surface of the wedge and from the direction of wedge axial movement.

According to a preferred embodiment of the present invention, said elastic blade is fixed by its rear end not to said axially movable wedge but to said gripper body, so preventing any wear of the blade and hook due to mutual rubbing of said elements consequent on the axial movements of the wedge and hence of the blade rigid with it.

The invention is described in detail hereinafter with reference to the accompanying drawings, which illustrate a preferred embodiment thereof by way of non-limiting example in that technical or constructional modifications can be made thereto without leaving the scope of the present invention.

DESCRIPTION OF THE PREFERRED EMBODIMENT(S)

Figure 1:
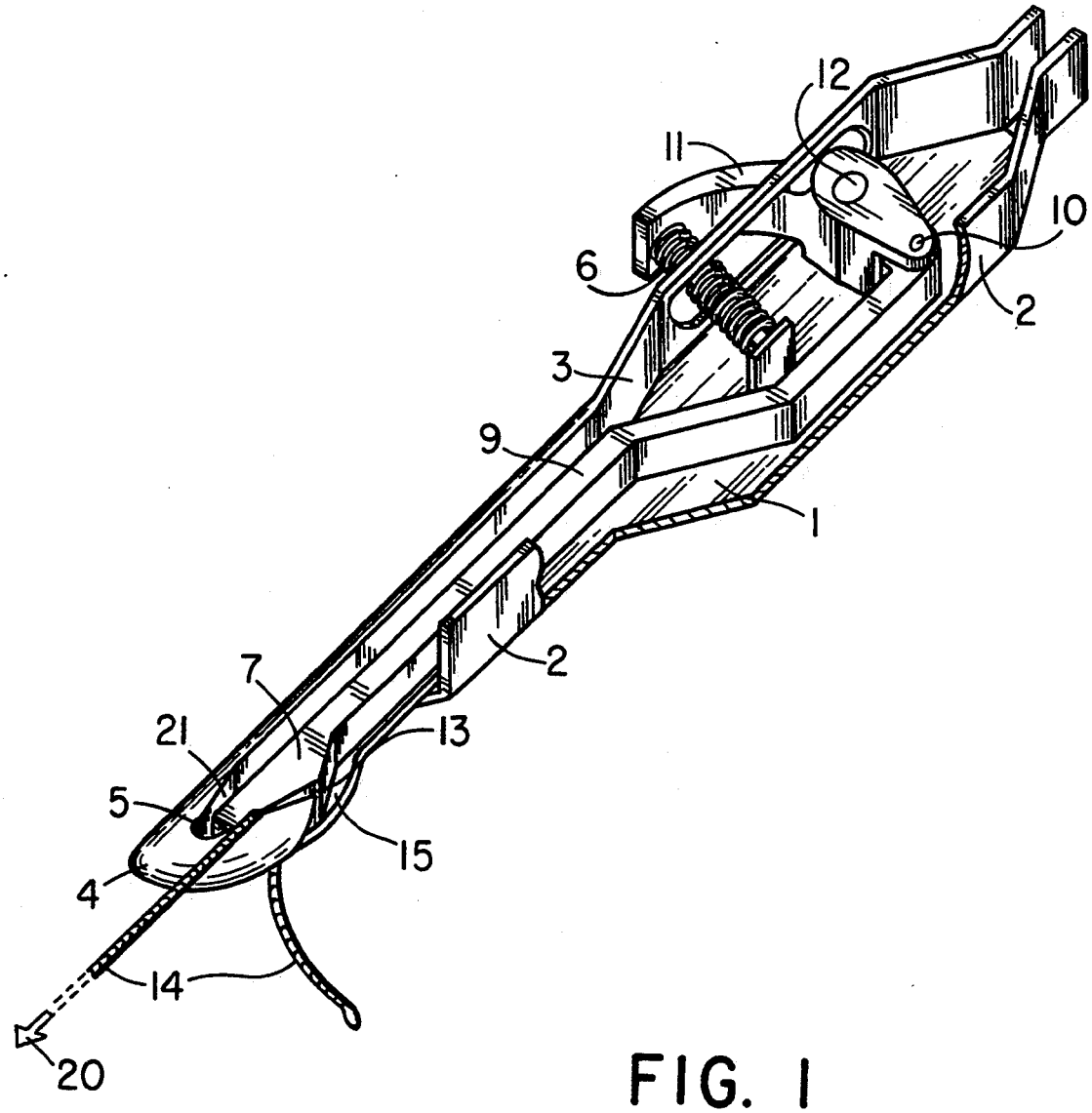
FIG. 1 is a partly sectional perspective view of a taker gripper formed in accordance with the invention.

In the FIGURES the reference numeral 1 indicates the taker gripper body comprising two sides 2 and 3 and terminating at its front in a horizontal hook 4.

Figure 2:
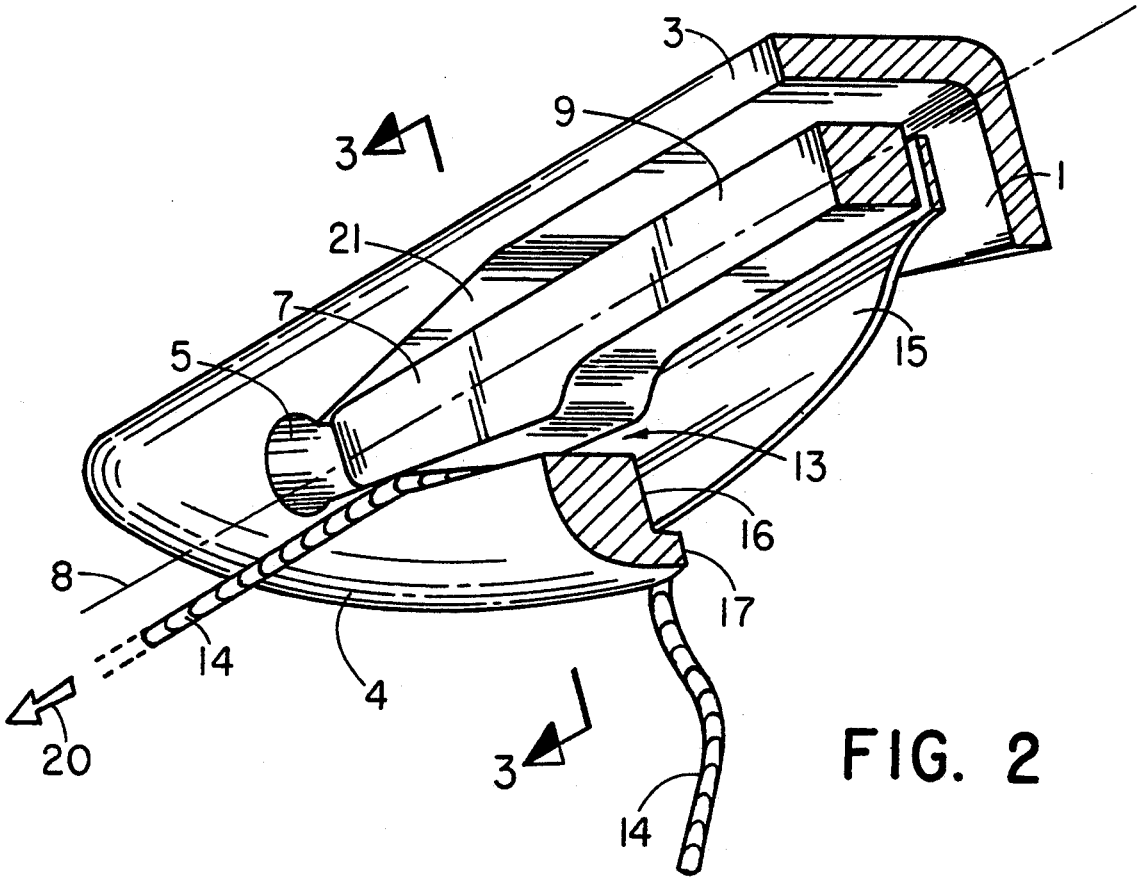
FIG. 2 is a perspective sectional view of the hook end of the gripper of FIG. 1, to an enlarged scale.

Said hook 4 defines a cavity 5 with side walls 5' and 5'' against which a wedge 7 is maintained elastically pressed by a spring 6, this wedge being axially movable in the direction 8 (see FIG. 2) by being carried at the front end of a bar 9, the rear free end of which is hinged by the vertical pin 10 to one end of a lever 11 which is pivoted at its center to the gripper body 1 by the vertical pin 12 and has its other end emerging from the side 3 of the gripper body 1 to cooperate with said spring 6.

On one of its sides said wedge forms with said wall 5' of the cavity 5 of said hook 4 a narrow V recess 13 into which the weft 14 is inserted and becomes wedged.

Figure 3:
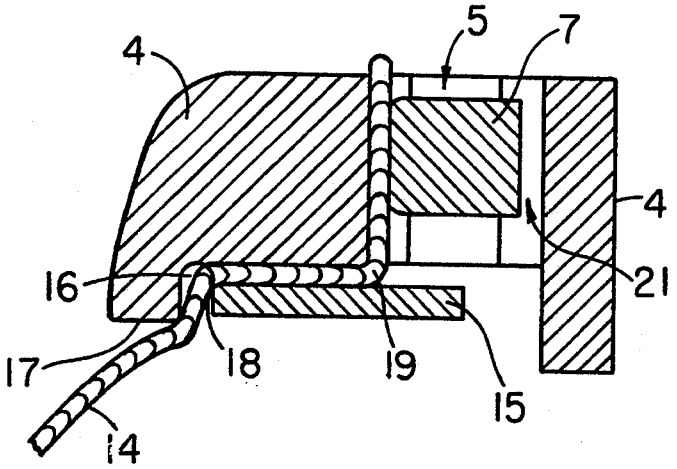
FIG. 3 is a cross-section on the line AA of FIG. 2 to a different scale.

Said weft 14 is also maintained elastically pressed by an elastic blade 15 against a shallow recess 16 provided in the outer lower surface 17 of the hook 4, so that the weft 14 is obliged to undergo two sudden deviations 18 and 19 (see FIG. 3) which, together with its gripping by the blade 15 against the shallow recess 16, provides it with consistent resistance to top withdrawal in the direction of the arrow 20.

Said elastic blade 15 is fixed by its rear end 15' (see FIG. 1) either to the bar 9 of the wedge 7 or to the gripper body 1. Finally, that inner surface 5'' of the cavity 5 of the hook 4 located on the side opposite that comprising the V recess 13 diverges from the corresponding surface 7' of the wedge 7 and from the direction 8 of its axial movement so as to form an empty region 21 between said surfaces 5'' and 7'.

In this manner, when the taker gripper is in each end of travel position and a fixed cam acts on the projecting end of the lever 11 against the action of the spring 6 to cause the wedge 7 to retract axially in the direction 8, this latter is able to rotate about the pin 10 into said empty region 21 towards the wall 5'', to obtain a corresponding widening of the recess 13 and facilitate release of the weft 14.

We claim:

1. A taker gripper for drawing a weft in loom use, comprising a gripper body provided at one end with a horizontally positioned movable hook having an outer lower surface and an inner surface within which an axially movable wedge having a free edge is maintained elastically pressed by a spring to form on one side of said hook a narrow V recess into which the weft to be drawn is inserted and wedged, said spring acting on that end of a lever extending externally to the gripper body, the lever being hinged at its center to said gripper body and having the free end of said wedge hinged to its other end, characterized in that said weft is also maintained elastically pressed by an elastic blade that has a rear end against a shallow recess provided in the outer lower surface of the hook, and that inner surface of the hook on the side opposite the side of said hook that forms said narrow V recess is formed so that it diverges from the corresponding surface of the wedge and from the direction of wedge axial movement.

2. A taker gripper for loom use as claimed in claim 1, characterized in that said elastic blade is fixed by its rear end to said axially movable wedge.

3. A taker gripper for loom use as claimed in claim 1, characterized in that said elastic blade is fixed by its rear end to said gripper body.

* * * * *